US009673508B2

(12) United States Patent
Lee et al.

(10) Patent No.: US 9,673,508 B2
(45) Date of Patent: Jun. 6, 2017

(54) ANTENNA DEVICE AND ELECTRONIC DEVICE HAVING THE SAME

(71) Applicant: Samsung Electronics Co., Ltd., Suwon-si, Gyeonggi-do (KR)

(72) Inventors: Sung-Hyup Lee, Gumi-si (KR); Soon-Sang Park, Daegu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 196 days.

(21) Appl. No.: 14/291,419

(22) Filed: May 30, 2014

(65) Prior Publication Data

US 2014/0375510 A1 Dec. 25, 2014

(30) Foreign Application Priority Data

Jun. 21, 2013 (KR) ..... 10-2013-0071325

(51) Int. Cl.
*H01Q 1/24* (2006.01)
*H01Q 5/371* (2015.01)
*H01Q 5/378* (2015.01)

(52) U.S. Cl.
CPC ..... *H01Q 1/243* (2013.01); *H01Q 5/371* (2015.01); *H01Q 5/378* (2015.01)

(58) Field of Classification Search
CPC ..... H01Q 1/24
USPC ..... 343/702, 876
See application file for complete search history.

(56) References Cited

U.S. PATENT DOCUMENTS

| | | | | |
|---|---|---|---|---|
| 8,432,234 | B2 * | 4/2013 | Manssen | H03H 7/40 333/17.3 |
| 8,988,296 | B2 * | 3/2015 | Koskiniemi | G01S 19/14 343/702 |
| 9,123,990 | B2 * | 9/2015 | Ramachandran | H01Q 1/243 |
| 9,203,154 | B2 * | 12/2015 | Korva | H01Q 1/243 |
| 9,246,210 | B2 * | 1/2016 | Korva | H01Q 1/243 |
| 9,246,223 | B2 * | 1/2016 | Badaruzzaman | H03H 7/40 |
| 9,246,237 | B2 * | 1/2016 | Jagielski | H01Q 1/243 |
| 2007/0273606 | A1 * | 11/2007 | Mak | H01Q 1/243 343/876 |

FOREIGN PATENT DOCUMENTS

| | | | |
|---|---|---|---|
| JP | 2006-54847 | A | 2/2006 |
| KR | 10-2009-0086218 | A | 8/2009 |
| KR | 10-2010-0085294 | A | 7/2010 |
| KR | 10-1174739 | B1 | 8/2012 |

* cited by examiner

*Primary Examiner* — Huedung Mancuso
(74) *Attorney, Agent, or Firm* — Jefferson IP Law, LLP

(57) ABSTRACT

An electronic device is provided. The electronic device includes a first antenna radiator operating in at least one frequency band, and at least one second antenna radiator disposed proximate to the first antenna radiator coupled to at least one radiation pattern of the first antenna radiator, and to operate as a parasitic resonator.

16 Claims, 7 Drawing Sheets

ANTENNA DEVICE AND ELECTRONIC DEVICE HAVING THE SAME

CROSS-REFERENCE TO RELATED APPLICATION(S)

This application claims the benefit under 35 U.S.C. §119 (a) of a Korean patent application filed on Jun. 21, 2013 in the Korean Intellectual Property Office and assigned Serial number 10-2013-0071325, the entire disclosure of which is hereby incorporated by reference.

TECHNICAL FIELD

The present disclosure relates to an antenna device. More particularly, the present disclosure relates to an electronic device having the antenna device.

BACKGROUND

Recently, portable electronic devices for communication have been developed to have various functions in order to meet a user's desire. For example, in addition to basic communication functions, an electronic device may allow a user to listen to various music using an MP3 sound source, to enjoy web surfing using a wireless Internet network, to download various programs via the network to use the same, and to reproduce a high image quality moving picture at fast speed in order to view the same.

Also, the electronic device may have at least one megapixel image pick-up element (i.e., a camera lens assembly) to capture a picture of an object. Recently, not only a still picture, but also a moving picture shooting function, e.g., a three-dimensional shooting function, has become widely used.

Additionally, in another aspect of a communication function, various patterns of operating in different frequency bands have been configured and used together in one antenna radiator. For example, various bands such as Code Division Multiple Access (CDMA), Personal Communications Service (PCS), Digital Cellular System (DCS), Global System for Mobile Communications (GSM), etc., may be used in common employing one antenna radiator. Similarly, a communication function such as WiFi, Global Positioning System (GPS), Bluetooth, etc., may be used via one antenna radiator.

Recent electronic devices also have a satellite navigation system, such as a GPS or a Global Navigation Satellite System (GLONASS), etc., in order to utilize various position information, and require an antenna radiator in order to receive a radio wave coming from a satellite. Since this satellite radio signal has a very weak magnitude compared to other communication signals, and since it and may be influenced by an obstacle, etc., an antenna device having excellent performance is essential for determining a more accurate position.

Therefore, a need exists for a high performance antenna device operating across various frequency bands in an electronic device, the electronic device being capable of getting slimmer gradually as demand requires.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device and an electronic device having the antenna device.

Another aspect of the present disclosure is to provide an antenna device configured to implement a sufficient radiation performance even though a leisurely mounting space is not secured, and an electronic device having the same.

Still another aspect of the present disclosure is to provide an antenna device configured to achieve a sufficient radiation performance without design limitations, and an electronic device having the same.

Yet another aspect of the present disclosure is to provide an antenna device configured to improve radiation performance of an antenna radiator using an existing neighbor instrument, without a separate additional means, and an electronic device having the same.

In accordance with an aspect of the present disclosure, an electronic device is provided. The electronic device includes a first antenna radiator configured to operate in at least one frequency band, and at least one second antenna radiator disposed proximate to the first antenna radiator coupled to at least one radiation pattern of the first antenna radiator, and configured to operate as a parasitic resonator.

In accordance with another aspect of the present disclosure, an antenna device is provided. The antenna device includes a first antenna radiator configured to operate in at least one frequency band, and at least one second antenna radiator disposed proximate to the first antenna radiator coupled to at least one radiation pattern of the first antenna radiator, and configured to operate as a parasitic resonator.

In accordance with still another aspect of the present disclosure, an electronic device is provided. The electronic device includes a substrate, an antenna carrier installed on the substrate or installed to avoid the substrate and having a predetermined height, a main antenna radiator disposed on an upper surface of the antenna carrier, fed from the substrate, and configured to operate in at least one frequency band, and at least one auxiliary antenna radiator disposed proximate to the main antenna radiator, coupled to at least one radiation pattern of the main antenna radiator, and configured to operate as a parasitic resonator.

Other aspects, advantages and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components and structures.

DETAILED DESCRIPTION

Figure 1:
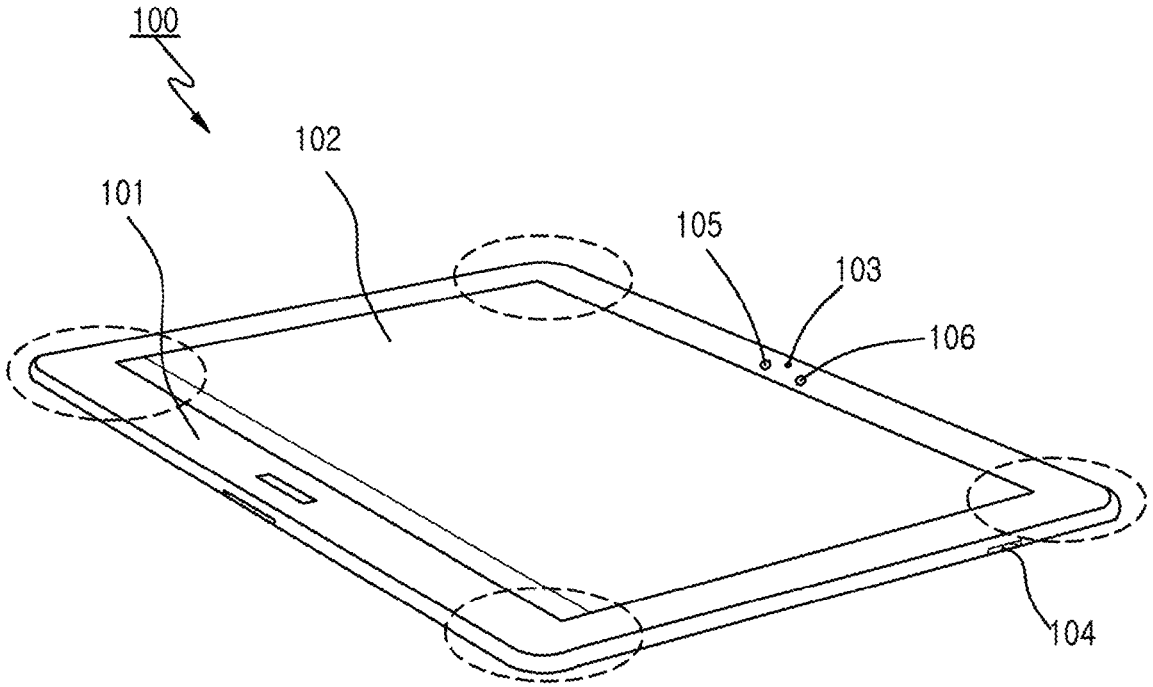
FIG. 1 is a perspective view illustrating an electronic device having an antenna device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In describing various embodiments of the present disclosure, an electronic device is applicable to various types of devices having a communication function.

In describing various embodiments of the present disclosure, a tablet type electronic device including a touchscreen as a display unit has been illustrated and described, but the present disclosure is not limited thereto. For example, the present disclosure is applicable to various devices including an antenna device for communication as an electronic device, that is, various devices such as a Personal Digital Assistant (PDA), a laptop computer, a mobile phone, a smart phone, a netbook, a Mobile Internet Device (MID), an Ultra Mobile PC (UMPC), a tablet Personal Computer (PC), a navigation, a wearable electronic device, a flexible electronic device, etc.

According to various embodiments of the present disclosure, the auxiliary antenna device may be disposed at a position where at least a portion of the auxiliary antenna device overlaps the main antenna radiator.

According to various embodiments of the present disclosure, the auxiliary antenna radiator may be disposed in parallel so that it does not overlap the main antenna radiator.

According to various embodiments of the present disclosure, the auxiliary antenna radiator may be at least one of a metal plate of a predetermined area, a printed circuit of flexibility including a metal pattern, and a conductive tape disposed inside the electronic device.

According to various embodiments of the present disclosure, the auxiliary antenna radiator may be a metal instrument of the electronic device. According to an embodiment, the metal instrument may be at least one of a metal vibrator, a motor, a metal tape, a portion of a shield can, a metal bushing having a predetermined area, and a metal bracket.

According to various embodiments of the present disclosure, the main antenna radiator may be disposed in such a way that it is attached on an upper surface of an antenna carrier having a predetermined area and a predetermined height.

According to various embodiments of the present disclosure, the main antenna radiator may be formed in a pattern type on a substrate of the electronic device.

According to various embodiments of the present disclosure, the auxiliary antenna radiator may be disposed in such a way that it is attached on an inner surface of a case frame of the electronic device.

According to various embodiments of the present disclosure, the auxiliary antenna radiator may be insert-molded in the case frame of the electronic device. According to an embodiment of the present disclosure, the auxiliary antenna radiator may be insert-molded in such a way that it is exposed to an inner surface of the case frame or exposed to an outer surface of the case frame. According to an embodiment of the present disclosure, in case of being exposed to the outer surface of the case frame, the auxiliary antenna radiator may be used as an ornament.

According to various embodiments of the present disclosure, a radiation pattern of the main antenna radiator that couples to the auxiliary antenna radiator may be a radiation pattern operating in a GPS band.

According to various embodiments of the present disclosure, the electronic device may be one of a tablet PC and a mobile communication terminal.

FIG. 1 is a perspective view illustrating an electronic device having an antenna device according to an embodiment of the present disclosure.

Referring to FIG. 1, the electronic device 100 may include a display module 102 installed to a front side 101 of the electronic device 100. For the display module 102, a touchscreen device including a touch panel where an input and an output may occur simultaneously and a Liquid Crystal Display (LCD) module may be applied.

At least one microphone unit 103 may be installed to an upper portion of the display module 102, and at least one speaker unit 104 may be installed on a side portion of the electronic device 100. According to an embodiment, a camera module 105 may be installed on the front side of the electronic device 100, and a sensor module 106 may be installed as a detection means for controlling the electronic device depending on a neighboring environment.

According to an embodiment of the present disclosure, the electronic device 100 may perform a communication function. For example, besides a basic communication function, the electronic device 100 may perform short distance communication via a Bluetooth module, a Wi-Fi module, etc., which are short distance communication modules. According to an embodiment, the electronic device 100 may include a GPS module for executing a position-based service using a satellite navigation system.

Figure 2:
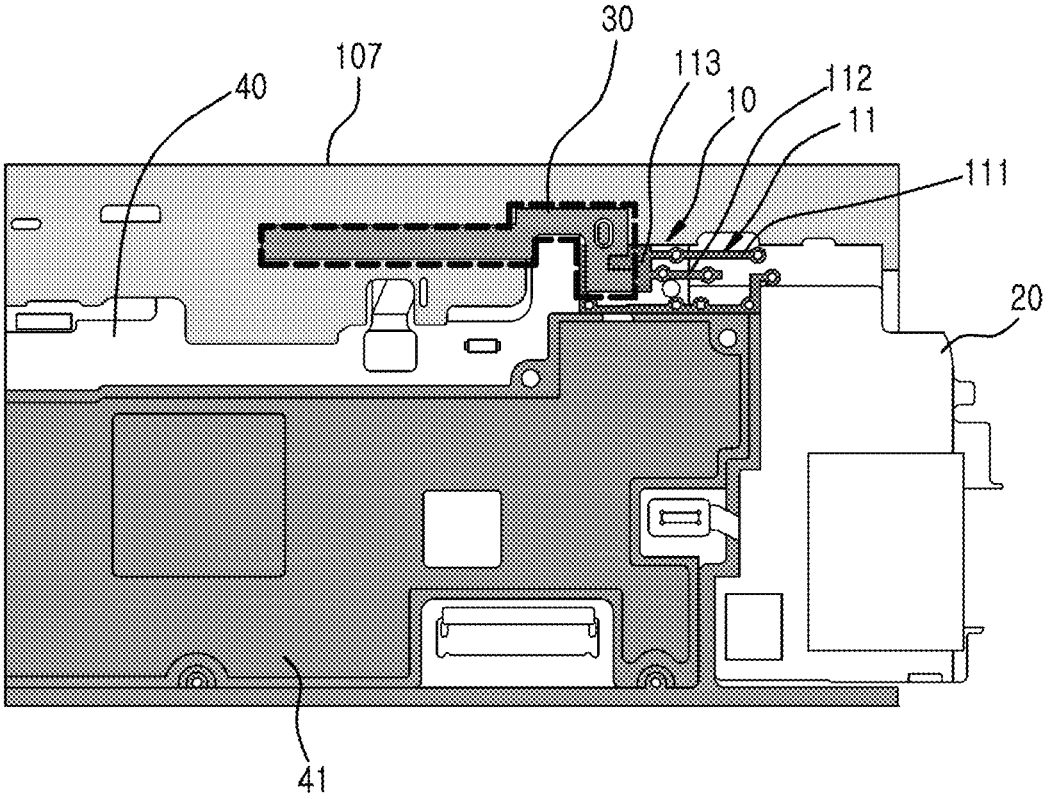
FIG. 2 is a view illustrating a construction of an antenna device installed in an electronic device according to an embodiment of the present disclosure.

The above-described communication module may include an antenna device 10 (of FIG. 2). The antenna device may be implemented using a conductive radiator to operate in a frequency band corresponding to each relevant module. The antenna device may have an antenna pattern which operates across a plurality of bands together in one conductive radiator. This antenna radiator is called a multi-band antenna radiator, and it may be implemented to operate in a desired frequency band in a switching method in a similar band or a frequency matching method by a matching circuit.

According to an embodiment of the present disclosure, a mounting space inside the electronic device is allowed for the antenna device, and the antenna device is disposed at a position having design limits which cause it to be relatively small. The antenna device may be disposed in regions displayed by dotted lines of FIG. 1. However, embodiments are not limited thereto, and the antenna device may be installed at various positions of the electronic device and may involve various methods.

According to various embodiments of the present disclosure, a metal auxiliary antenna radiator for parasitic resonance may be disposed in a vicinity of a region where the antenna radiator has been disposed. The metal auxiliary antenna radiator may be disposed at a position separated from the antenna radiator by a predetermined interval but where coupling may occur.

Hereinafter, an antenna device according to the present disclosure is described.

FIG. 2 is a view illustrating a construction of an antenna device installed in an electronic device according to an embodiment of the present disclosure.

Figure 3:
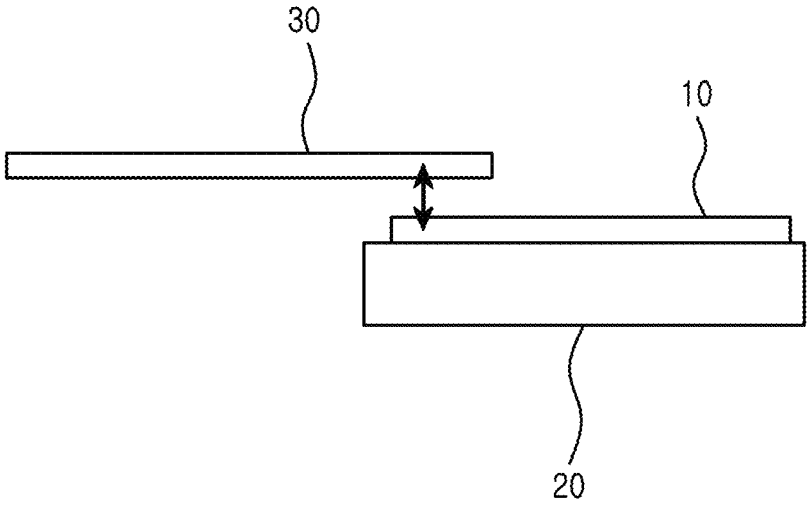
FIG. 3 is a side view illustrating an antenna device according to an embodiment of the present disclosure.

FIG. 3 is a side view illustrating an antenna device according to an embodiment of the present disclosure.

Referring to FIGS. 2 and 3, an antenna carrier 20 having a predetermined area and a predetermined height may be installed to a substrate (e.g., a Printed Circuit Board (PCB)) 40 installed inside the case frame 107 of the electronic device 100. The antenna carrier 20 may be installed to the substrate 40 or installed to avoid the substrate 40. A plurality of electronic parts (i.e., an electronic function group) may be mounted on the substrate, and a shield can 41 for shielding electromagnetic waves may be stacked.

The antenna device 10 according to the present disclosure may include a main antenna radiator 11 mounted on the antenna carrier 20, and an auxiliary antenna radiator 30 installed in the vicinity of the main antenna radiator 11 to generate parasitic resonance via a coupling operation with the main antenna radiator 11.

The main antenna radiator 11 may be installed such that a plurality of radiation patterns whose shapes are different are connected with each other. For example, three antenna radiation patterns 111, 112, 113 may be disposed as in FIG. 2. A first radiation pattern 111 may be a radiation pattern for WiFi communication operating in a 5 GHz-band. A second radiation pattern 112 may be a radiation pattern for Bluetooth communication operating in a 2.4 GHz-band. A third radiation pattern 113 may be a radiation pattern for GPS communication operating in a 1.5 GHz-band. This antenna radiator 11 may be formed of various shapes that may communicate in various communication schemes in various bands besides the above-described radiation bands.

Though not shown, the main antenna radiator 11 may include a feeding portion and a grounding portion. The feeding portion may be electrically connected to an RF connector of the substrate 40, and the grounding portion may be electrically connected to a grounding region of the substrate 40.

In an embodiment, the main antenna radiator 11 is attached to the upper surface of the antenna carrier 20 of a predetermined height, disposed on the upper portion of the substrate 40 or disposed to avoid the substrate 40 in a metal plate type, but is not limited thereto. For example, when a space of the substrate 40 is allowed, the main antenna radiator 11 may be directly formed on the substrate in a pattern. Also, the main antenna radiator 11 may be a plurality of radiation patterns of a predetermined shape formed on a PCB side separated from the substrate.

The auxiliary antenna radiator 30 according to the present disclosure is disposed in the vicinity of the main antenna radiator 11. According to an embodiment of the present disclosure, the auxiliary antenna radiator 30 may be separated by a distance where coupling with at least one radiation pattern of the main antenna radiator 11 may occur. As illustrated, the auxiliary antenna radiator 30 may be installed in the vicinity of the third radiation pattern 113 operating in a GPS band among the radiation patterns 111, 112, 113 of the main antenna radiator 11.

According to an embodiment of the present disclosure, the auxiliary antenna radiator 30 may be disposed at a position where at least a portion of the auxiliary antenna radiator 30 overlaps the third radiation pattern 113 of the main antenna radiator 11. According to an embodiment of the present disclosure, the auxiliary antenna radiator 30 may be disposed at a position where coupling may occur while not overlapping the third radiation pattern 113.

According to an embodiment of the present disclosure, the auxiliary antenna radiator 30 may be at least one of a metal plate having a separately prepared predetermined area, a printed circuit of flexibility having a metal pattern, and a conductive tape. According to an embodiment of the present disclosure, the auxiliary antenna radiator 30 may not be prepared separately but may be at least one of a metal bracket, a bushing, a vibrator, a shield can which are annex instruments of the electronic device. According to an embodiment of the present disclosure, the auxiliary antenna radiator 30 may be configured in the plural.

Figure 4:
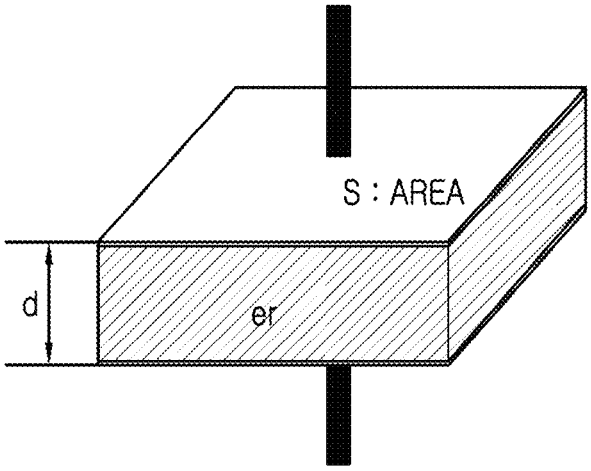
FIG. 4 is a schematic view for calculating a capacitance of a dielectric between two metal plates according to an embodiment of the present disclosure.

FIG. 4 is a schematic view for calculating a capacitance of a dielectric between two metal plates according to an embodiment of the present disclosure.

Referring to FIG. 4, a dielectric constant of a dielectric (e.g., air, a case frame, etc.) between two metal plates may be used, and an area S of a metal plate by a capacitance value C may be calculated by Equation (1) below:

$$C = \varepsilon \frac{S}{d} \qquad \text{Equation (1)}$$

where C is capacitance between two metal plates, S is an area of the metal plate, d is a separation distance between the plates, ∈ is ∈r×∈0 (γr: non-dielectric constant, ∈0=8.854×10−12). That is, since the capacitance value C is inversely proportional to the separation distance d between the two plates, and proportional to the area S of the plate, a desired value C may be calculated. Therefore, when a value C with consideration of an impedance value in a desired frequency band is given, the area S of the two metal plates with consideration of the separation distance may be calculated.

According to an embodiment of the present disclosure, in the case where reception strength of the third radiation pattern operating in a GPS frequency band is measured without the auxiliary antenna radiator, −145.05 dB is detected. In contrast, in the case where reception strength is measured with the auxiliary antenna radiator overlapping on the upper portion of the third radiation pattern, the reception performance of −150.88 dB has been expressed. That is, performance has improved by about 5.8 dB.

Figure 5:
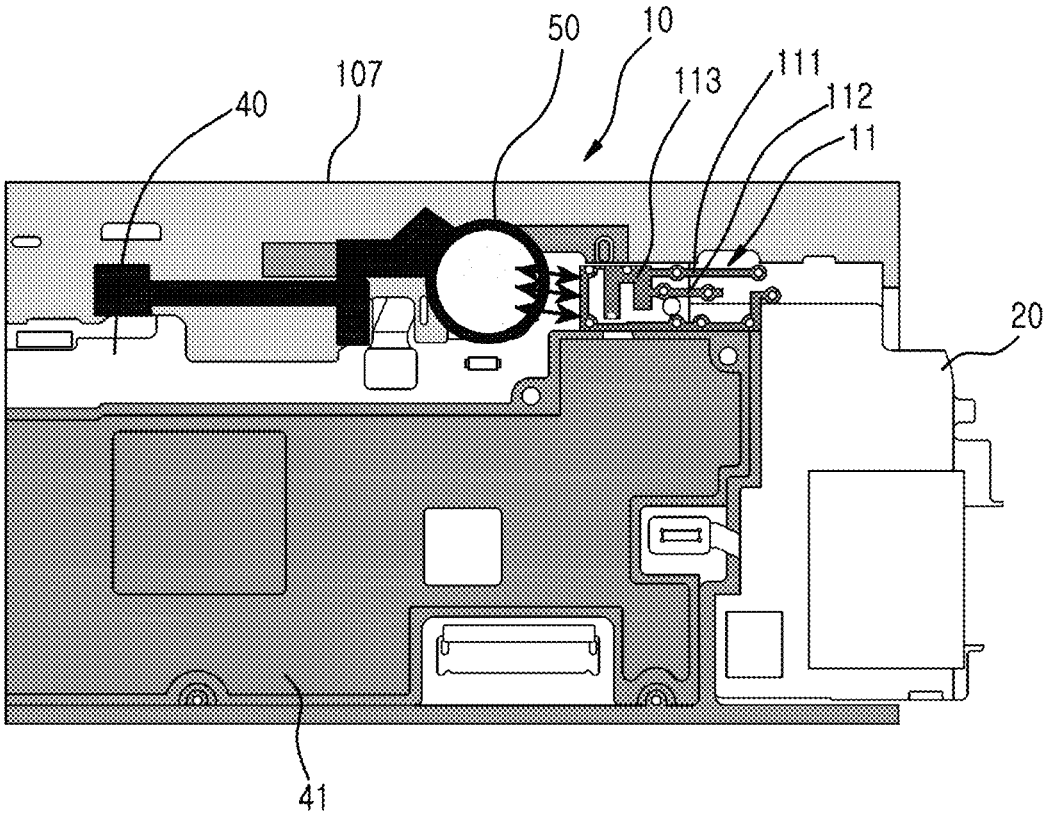
FIG. 5 is a view illustrating a construction of an antenna device installed in an electronic device according to an embodiment of the present disclosure.

FIG. 5 is a view illustrating a construction of an antenna device installed in an electronic device according to an embodiment of the present disclosure.

Referring to FIG. 5, inside case frame 107, the antenna carrier 20 is disposed on the upper portion of the substrate 40 or disposed to avoid the substrate 40, and the main antenna radiator 11 may be installed to the upper surface of the antenna carrier 20. A vibrator 50 may be installed on one side of the main antenna radiator 11. The vibrator 50 may include a metal housing and a motor, and may be separated by a distance where coupling with the main antenna radiator 11 is possible. Additionally, the antenna device 10 may include three antenna radiation patterns 111, 112, 113 disposed as depicted. A shield can 41 for shielding electromagnetic waves may also be used.

In the present embodiment, a separate metal body is not used as the auxiliary antenna radiator, but instead, a metal instrument inside the electronic device may be used as a substitute. In this case, the main antenna radiator 11 and the metal instrument may be disposed in a parallel, not disposed at an overlapping position. Though a metal vibrator 50 is disposed in the present embodiment, other instruments may be disposed. For example, various metal instruments, such as a metal tape, a portion of a shield can, a metal bushing having a predetermined area, a bracket, etc., may be used as a substitute.

Figure 6:
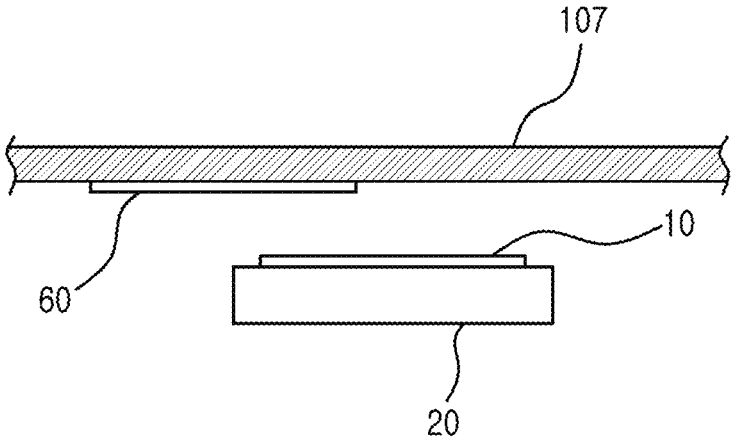
FIG. 6 is a side view illustrating an antenna device according to an embodiment of the present disclosure.
Figure 7:
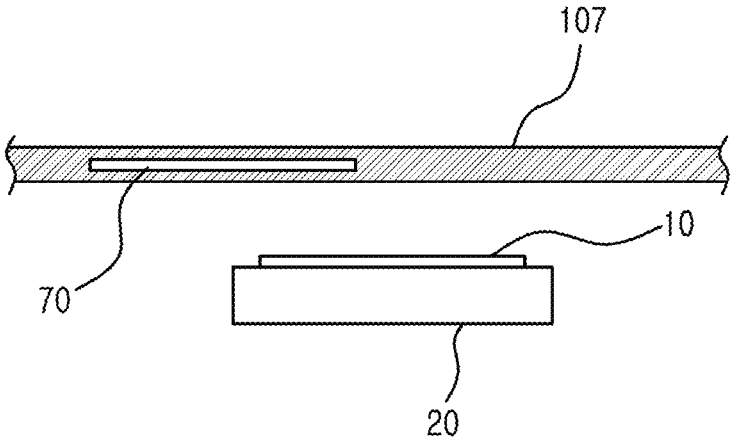
FIG. 7 is a side view illustrating an antenna device according to another embodiment of the present disclosure.

FIGS. 6 and 7 are side views illustrating an antenna device according to embodiments of the present disclosure.

Referring to FIG. 6, an auxiliary antenna radiator 60 may be a plate type, and may be attached to an inner surface of a case frame 107 of the electronic device. According to an embodiment, the auxiliary antenna radiator 60 may be a metal plate and may be a printed circuit having flexibility where a metal pattern has been formed, and a metal spray layer having a predetermined area and a predetermined thickness, coated on the inner surface of the case frame 107. The antenna device 10 may be mounted on the antenna carrier 20 as shown.

Referring to FIG. 7, an auxiliary antenna radiator 70 may be formed of a metal plate and insert-molded in the case frame 107 of the electronic device. In this case, the case frame 107 may be formed of a synthetic resin, and the metal plate may coincide with the inner surface of the case frame 107, may coincide with the outer surface of the case frame 107, or may be molded so as to be inserted into the case frame 107. According to an embodiment of the present disclosure, the metal plate may be attached so as to be exposed to the outer surface of the case frame, or fixed in a way of being insert-molded to operate as a parasitic resonator, and simultaneously may contribute to making an appearance of the electronic device elegant as a metal ornament (decoration). The antenna device 10 may be mounted on the antenna carrier 20 as shown.

According to various embodiments of the present disclosure, performance deterioration of an antenna radiator due to a shortage of a mounting space of the electronic device may be prevented in advance, and a radiation characteristic of an antenna radiator may be improved even when design constraints necessitate the use of limit space, and operations must occur in space as small as possible without the possibility of space extension.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a first antenna radiator configured to operate in at least one frequency band; and at least one second antenna radiator disposed in a neighborhood of the first antenna radiator, wherein the at least one second antenna radiator is electrically coupled to at least one radiation pattern of the first antenna radiator to operate as a parasitic resonator, and wherein the second antenna radiator is at least one of a metal vibrator, a motor, a metal tape, a portion of a shield can, a metal bushing having a predetermined area, and a metal bracket.

2. The electronic device of claim 1, wherein the second antenna radiator is disposed in parallel so that it does not overlap the first antenna radiator.

3. The electronic device of claim 1, wherein the second antenna radiator is at least one of a metal plate of a predetermined area disposed inside the electronic device, a printed circuit board of flexibility comprising a metal pattern and a conductive tape.

4. The electronic device of claim 1, wherein the first antenna radiator is disposed in such a way that it is attached on an upper surface of an antenna carrier having a predetermined area and a predetermined height.

5. The electronic device of claim 1, wherein the first antenna radiator is formed in a pattern on a substrate of the electronic device.

6. The electronic device of claim 1, wherein a radiation pattern of the first antenna radiator that couples with the second antenna radiator is a radiation pattern operating in a global positioning system (GPS) band.

7. The electronic device of claim 1, wherein the electronic device is one of a tablet personal computer (PC) and a mobile communication terminal.

8. An antenna device comprising:

a first antenna radiator configured to operate in at least one frequency band; and at least one second antenna radiator independently disposed proximate to the first antenna radiator electrically coupled to at least one radiation pattern of the first antenna radiator, and configured to operate as a parasitic resonator, wherein the at least one second antenna radiator is at least one of a metal vibrator, a motor, a metal tape, a portion of a shield can, a metal bushing having a predetermined area, and a metal bracket.

9. An electronic device comprising:

a housing comprising an interior region;

a substrate mounted in the interior region;

an antenna carrier installed on the substrate;

a main antenna radiator disposed on an upper surface of the antenna carrier, fed from the substrate, and configured to operate in at least one frequency band; and a metal plate disposed at a position, which is spaced apart from the main antenna radiator, of the housing such that at least a portion of the metal plate is disposed in parallel with at least a portion of the main antenna radiator, wherein the metal plate is electrically coupled to at least one radiation pattern of the main antenna radiator such that the metal plate operates as a parasitic resonator.

10. The electronic device of claim 9, wherein the metal plate comprises at least part of a printed circuit board of flexibility comprising a metal pattern and a conductive tape.

11. The electronic device of claim 9, wherein the metal plate is at least part of a metal vibrator, a motor, a metal tape, a shield can, a metal bushing having a predetermined area, and a metal bracket.

12. The electronic device of claim 9, wherein a radiation pattern of the main antenna radiator that couples to the metal plate is a radiation pattern operating in a global positioning system (GPS) band.

13. The electronic device of claim 9, wherein the metal plate is disposed in such a way that it is attached on an inner surface of the housing of the electronic device.

14. The electronic device of claim 9, wherein the metal plate is insert-molded in the housing of the electronic device.

15. The electronic device of claim 14, wherein the metal plate is insert-molded in such a way that it is exposed to an inner surface of the housing or exposed to an outer surface of the housing.

16. The electronic device of claim 15, wherein when exposed to the outer surface of the housing, the metal plate is utilized as an ornament.

* * * * *